US009108226B1

(12) United States Patent
SerVaas

(10) Patent No.: US 9,108,226 B1
(45) Date of Patent: Aug. 18, 2015

(54) CLEANING ATTACHMENT FOR HANDHELD ROTARY TOOL

(75) Inventor: Paul SerVaas, Indianapolis, IN (US)

(73) Assignee: SerVaas Laboratories Inc., Indianapolis, IN (US)

( * ) Notice: Subject to any disclaimer, the term of this patent is extended or adjusted under 35 U.S.C. 154(b) by 496 days.

(21) Appl. No.: 13/464,490

(22) Filed: May 4, 2012

(51) Int. Cl.

| | |
|---|---|
| ***B08B 1/00*** | (2006.01) |
| ***B08B 1/04*** | (2006.01) |
| ***A46B 11/00*** | (2006.01) |
| ***A46B 13/02*** | (2006.01) |
| ***A46B 13/04*** | (2006.01) |

(52) U.S. Cl.
CPC ..... *B08B 1/00* (2013.01); *A46B 11/001* (2013.01); *A46B 13/02* (2013.01); *A46B 13/04* (2013.01); *B08B 1/002* (2013.01); *B08B 1/04* (2013.01)

(58) Field of Classification Search
CPC ..... B08B 1/00; B08B 1/002; B08B 1/04; B08B 3/00; B08B 3/04; A46B 11/00; A46B 11/001; A46B 13/02; A46B 13/04
USPC ..... 134/6, 32, 33, 42; 15/22.1, 23, 24, 28, 15/29, 87, 21.1
See application file for complete search history.

(56) References Cited

U.S. PATENT DOCUMENTS

| | | | | |
|---|---|---|---|---|
| 3,102,294 | A * | 9/1963 | Miller et al. | 15/97.1 |
| 4,158,246 | A * | 6/1979 | Meadows et al. | 15/28 |
| 4,399,578 | A * | 8/1983 | Bordeaux | 15/97.1 |
| D292,834 | S | 11/1987 | Slachta | |
| 4,934,717 | A * | 6/1990 | Budelman et al. | 279/79 |
| 5,224,231 | A | 7/1993 | Nacar | |
| 5,423,102 | A | 6/1995 | Madison | |
| 5,950,268 | A | 9/1999 | Murphy et al. | |
| 5,967,887 | A | 10/1999 | Synowski | |
| 2008/0047085 | A1 * | 2/2008 | Kolarevic et al. | 15/179 |

OTHER PUBLICATIONS

Black & Decker Power Scrubber, Model #PKS160, [online], undated, [retrieved Apr. 29, 2012]. Retrieved from the Internet: http://www.blackanddecker.com/power-tools/PKS160.aspx, (1 page).

* cited by examiner

*Primary Examiner* — Saeed T Chaudhry
(74) *Attorney, Agent, or Firm* — William F. Bahret

(57) ABSTRACT

A cleaning attachment configured for mounting a conventional household sponge to the chuck of a cordless electric screwdriver. The cleaning attachment relieves a person of the manual labor involved in scrubbing a surface with a sponge by hand. The cleaning attachment also eliminates the need to purchase a specialized sponge that is designed and sold specifically to operate in conjunction with a rotary tool. The sponge can be easily dismounted, flipped over, and reattached for continued use.

15 Claims, 4 Drawing Sheets

CLEANING ATTACHMENT FOR HANDHELD ROTARY TOOL

BACKGROUND OF THE INVENTION

The present invention relates to attachments for power tools and more particularly to attachments for power tools for use in cleaning.

Manual and powered cleaning tools are known in the art, including, for example, handheld battery-powered rotary scrubbing tools made to receive brushes and scrub pads among other attachments, such as disclosed in U.S. Pat. No. 5,950,268 to Murphy et al. and U.S. Pat. No. 5,423,102 to Madison. Handheld power scrubbers are also available from Black & Decker. However, the tools cited above are all specialized devices.

U.S. Pat. No. 5,224,231 to Nacar discloses a brush attachment for a power tool such as an electric drill. U.S. Pat. No. 5,967,887 to Synowski discloses a polishing and buffing attachment for mounting to a rotating tool, the attachment including an elongate head member with an outer padded layer. Design Pat. No. 292,834 to Slachta discloses a design for an electric drill attachment for mounting cleaning pads or the like.

The above-referenced patents and products are representative examples of the prior art. However, a need remains for improved cleaning devices and methods employing handheld rotary tools. More particularly, there remains a need for more effective, easy-to-use cleaning attachments for rotary tools, and a need for cleaning methods which save labor without expensive equipment in the household and especially in commercial applications such as bars and restaurants where it is essential to control operating costs.

SUMMARY OF THE INVENTION

The present invention provides a cleaning attachment for a rotary tool having a chuck with a longitudinal bore therein, the cleaning attachment comprising a disk with front and rear surfaces and a peripheral edge groove therebetween, a rigid shaft extending perpendicularly from the center of the rear surface of the disk, the shaft configured to fit snugly within the bore of the rotary tool; and an O-ring circumscribing the peripheral edge groove, the O-ring having an inner diameter substantially equal to the outer diameter of the disk. A sorbent membrane, e.g., a conventional household sponge, has a surface disposed against the front surface of the disk, and a plurality of diametrically opposed portions that are squeezed into the groove by the O-ring.

Within the context of this disclosure, the term "rotary tool" means a handheld power tool designed to work with rotating accessory bits and attachments, such tools including screwdrivers, drills and the like, powered by electricity, air pressure and the like. The cleaning attachment relieves a person of the manual labor involved in scrubbing a surface with a sponge by hand. The cleaning attachment also eliminates the need to purchase a specialized sponge that is designed and sold specifically to operate in conjunction with a rotary tool.

One aspect of the invention is a method of cleaning a surface using a handheld electric screwdriver having a chuck for holding a screwdriver bit. The method comprises mounting a sponge on the front end of the screwdriver using a disk supported by a shaft inserted into the chuck, the disk having front and rear surfaces, a peripheral edge therebetween, and an annular groove formed in the peripheral edge, the sponge retained on the disk by an annular band around the peripheral edge and around diametrically opposed portions of the sponge, the band applying a compressive force against the opposed sponge portions so as to press them into the peripheral edge groove. A cleaner is applied to the surface to be cleaned and/or to the sponge, and the screwdriver is activated so as to rotate the disk and the attached sponge with the sponge bearing against the surface to be cleaned.

In preferred embodiments, the disk includes one or more wells and associated holes for supply of a liquid cleanser to the sorbent membrane. The shaft on the disk is preferably sized and shaped to provide a tight fit within the chuck, tight enough to provide frictional engagement sufficient to support the combined weight of the disk, shaft, O-ring, sorbent membrane, and any cleaning liquid in the sorbent membrane and/or wells in the disk when the rotary tool is pointed down toward a target surface. Ferromagnetic material may be employed to produce a magnetic attraction which augments the primary (friction fit) mode of shaft retention, or as an alternative. Without being bound to a specific theory of operation, it is believed that the flow of liquid cleanser from the wells into the sorbent membrane occurs due to gravity, capillary action associated with the structure of the sorbent membrane, low level centrifugal force caused by rotation of the disk and sorbent membrane at a low speed, e.g., about 200 rpm, and pumping action created by rhythmically compressing the sorbent membrane against the target surface.

The objects and advantages of the present invention will be more apparent upon reading the following detailed description in conjunction with the accompanying drawings.

DESCRIPTION OF PREFERRED EMBODIMENTS

Figure 1:
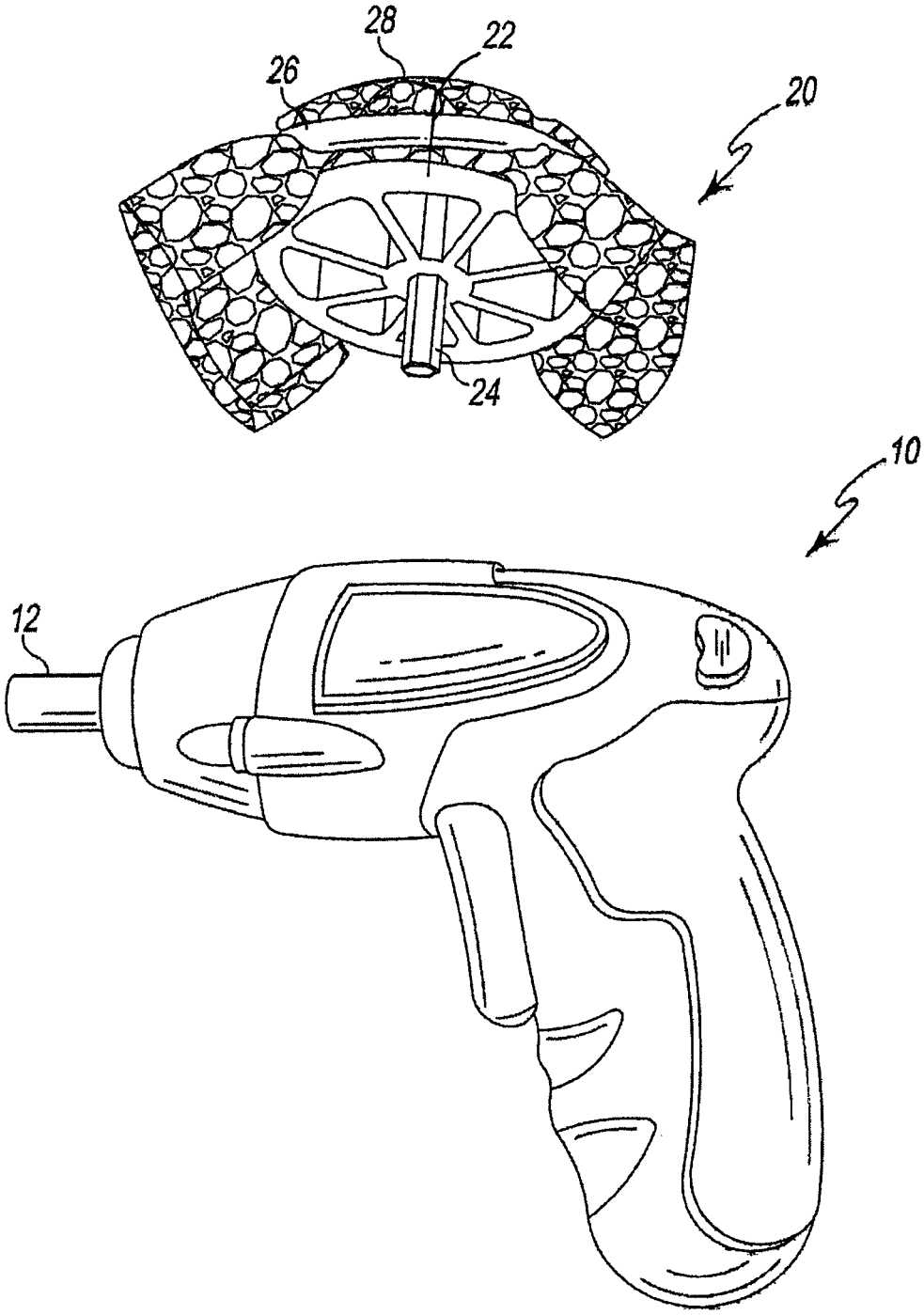
FIG. 1 is a perspective view of a rotary tool and a first embodiment of a cleaning attachment according to the present invention, having a sponge mounted thereto.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments and such further applications of the principles of the invention as illustrated therein being contemplated as would normally occur to one skilled in the art to which the invention relates.

Figure 2:
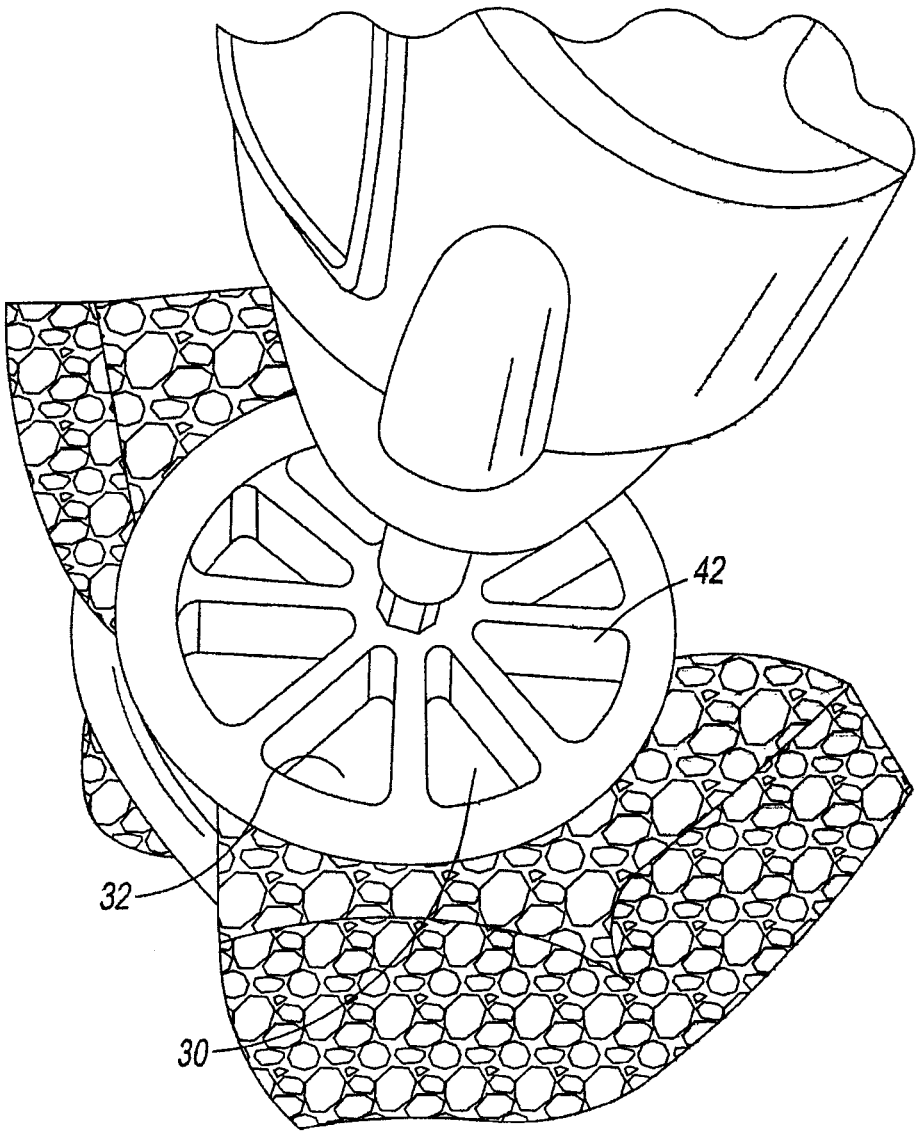
FIG. 2 is a rear perspective view of the first embodiment of the cleaning attachment attached to the rotary tool. The sponge is shown mounted to the cleaning attachment.

FIG. 1 is a perspective view of a rotary tool 10 and a first embodiment of a cleaning attachment 20 according to the present invention. Rotary tool 10 is preferably a cordless electric screwdriver which is capable of rotating clockwise and counterclockwise at a speed of approximately 200 rpm and which may be a variable-speed, reversible cordless screwdriver. Rotary tool 10 includes a cylindrical chuck 12 having a longitudinal, hexagonal bore therein. Cleaning attachment 20 includes a generally circular disk 22, a shaft 24 and an O-ring 26, and is configured to hold a conventional sponge 28 against the front of disk 22 and bent around the periphery of the disk as shown in FIGS. 1 and 2. Disk 22 comprises rigid, corrosion-resistant material, preferably nylon or ultra-high molecular weight (UHMW) plastic, e.g., ultra-high molecular weight polyethylene (UHMWPE), and has an outer diameter (O.D.) slightly smaller than the smallest transverse dimension of the sponge to be mounted on the disk, i.e., an O.D. smaller than the sponge width in the case of a rectangular sponge.

Shaft 24 may be a quarter-inch hex shaft made of rigid, corrosion-resistant material, e.g., stainless steel. It is sized to fit tightly within the bore of the chuck, via a friction or interference fit. The tightness of the fit between shaft 24 and the bore is sufficient to support the weight of cleaning attachment 20. This particular embodiment of cleaning attachment 20 weighs approximately 0.9 oz (without sponge attached). While a hexagon is the preferred shape for the cross-section of the shaft and bore, other shapes such as a triangle, rectangle, pentagon, and octagon are within the scope of the invention.

O-ring 26 is suitably made of butyl rubber or Buna-n rubber. Its inner diameter (I.D.) is preferably approximately equal to the O.D. of the disk, and it preferably has a thickness of approximately ¼ to ⅕ the thickness of the sponge. In this embodiment, for example, the O.D. of disk 22 is 2.56 inches, the I.D. of O-ring 26 is 2.5 inches, and the O-ring thickness is 3/16 inch.

Sponge 28 may be a common synthetic, rectangular household sponge, e.g., cellulose, without an abrasive side, having dimensions of, for example, 4.5 inches×2.7 inches×0.6 inches, and is held on disk 22 by O-ring 26. That is, O-ring 26 squeezes diametrically opposed portions of sponge 28 into a peripheral edge groove 36 (perhaps best shown in FIG. 4) in disk 22. Once attached to rotary tool 10, the exposed front surface of sponge 28 can be applied against a surface to be cleaned, while the opposite surface of the sponge bears against the front of disk 22 and extends beyond the disk periphery as illustrated.

FIG. 2 shows cleaning attachment 20 attached to the rotary tool, with sponge 28 mounted on the cleaning attachment. Disk 22 includes wells 30 and associated holes 32 which extend from the wells through the front surface 38 of the disk, thereby creating "leaky reservoirs" with holes 32 sized to allow liquid cleaning products to flow at a useful rate for continuous cleaning. The wells are adapted to hold cleaning liquid 42 which then seeps into the sponge due in part to gravity and in part to capillary action or suction associated with the structure of the sponge. The liquid flow is aided by low level centrifugal force caused by rotation of the sponge at about 200 rpm, and the radial locations of the holes take advantage of the low level centrifugal force. Pumping the sponge against a surface, i.e., rhythmically compressing and decompressing the sponge, also facilitates the absorption of cleaning liquid into the sponge from the wells.

Shaft 24 is frictionally engaged inside the bore of chuck 12 during use. The shaft fits tightly enough within the chuck 12 that the weight of the cleaning attachment, including the sponge and any cleaning liquid absorbed in the sponge and/or residing in wells 30, is supported by the frictional engagement of shaft 24 and chuck 12. Including the weight of the example sponge described above, the total weight of the sponge and cleaning attachment 20 (disk, shaft and O-ring) made of nylon with the dimensions disclosed herein is 2.7 oz. Accordingly, the frictional engagement is sufficient to support at least that much weight without any cleaning liquid, and sufficient to support, e.g., 3-4 oz. with cleaning liquid. In other embodiments, the shaft comprises a ferromagnetic material such as ferritic or martensitic stainless steel and magnetically engages with the chuck. Magnetic attraction may be employed to augment the primary (friction fit) mode of shaft retention, or as an alternative. The O-ring circumscribes the groove in the peripheral edge of the disk and squeezes the sponge against the disk.

Figure 4:
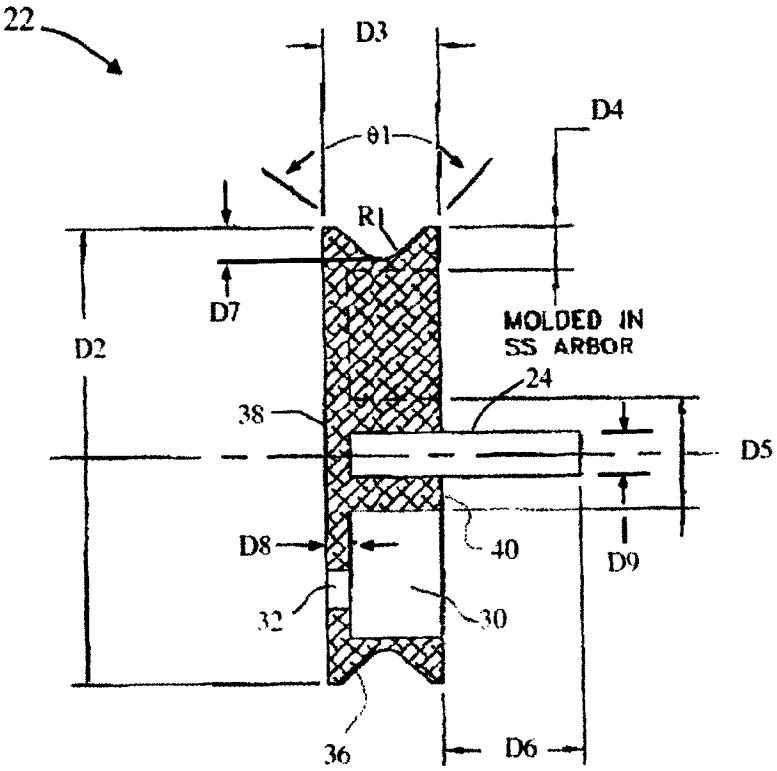
FIG. 4 is a cross-section of the disk and shaft of FIG. 3 taken along line 4-4 in FIG. 3.
Figure 3:
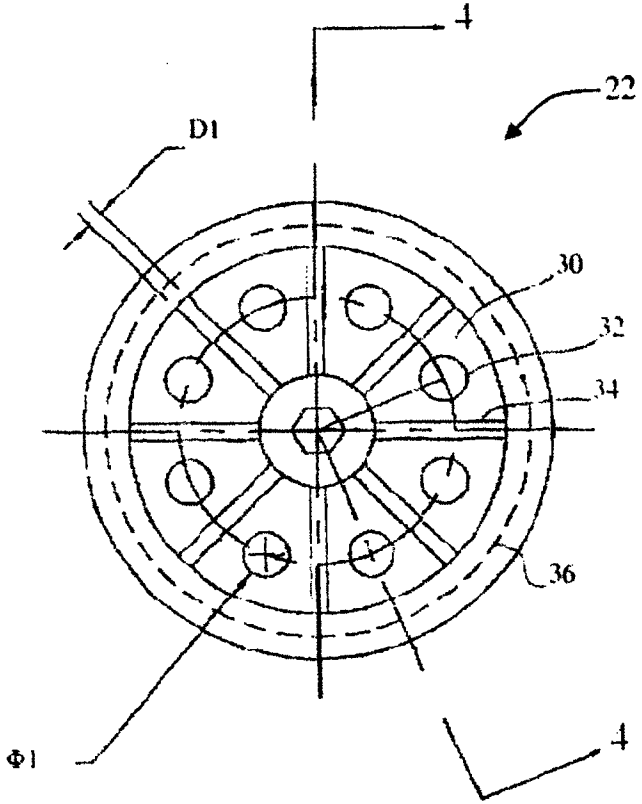
FIG. 3 is a rear end view of the disk and shaft of the first embodiment of the cleaning attachment.

The disk and shaft of cleaning attachment 20 are shown in further detail in FIGS. 3 and 4, which are scale drawings, drawn to the same scale, and which show the details of the wells 30, associated through holes 32, and peripheral edge groove 36. Shaft 24 is secured in an axial bore provided for this purpose in disk 22, the bore extending only partially through the disk as shown, and the shaft extends perpendicularly from the rear surface 40 of the disk. Each well 30 is bounded on either side by a wall 34 formed from the material of the disk and is open to the rear of the disk. Cleaning liquid is placed in the wells, from which it can flow through holes 32 to the sponge (not shown), as described with reference to FIG. 2. An additional function of the holes is to provide traction for the sponge. More specifically, with the lateral portions of the sponge squeezed against groove 36 by O-ring 26 as shown in FIGS. 1 and 2, the rear surface of the sponge bears against the front surface of the disk. When the sponge is attached in this manner and pressure is applied during use, the rear surface of the sponge puckers and protrudes slightly into the holes and thus functions as a traction surface, helping to lock the sponge to the disk and prevent it from slipping relative to the rotating disk and stalling when pressure is applied during use. This allows one to use a looser O-ring and still hold the sponge securely to the disk. A looser O-ring is easier to put on, which makes the product easier to use for people who have arthritis or otherwise have limited dexterity or strength.

As mentioned above, a portion of the length of shaft 24 is located within a bore in disk 22. The shaft is preferably secured in the bore by means of a friction or interference fit. In certain embodiments, the shaft may otherwise be securely engaged to the disk. For example, the shaft may be glued into place, or the shaft and the bore in the disk may have mating threads and be screwed together. Alternatively, as discussed below with reference to FIGS. 5 and 6, the shaft may be molded from and integral to the material of the disk. FIGS. 3 and 4 show dimensions (e.g., D1, D2, and D3), radii of curvature (e.g., R1), diameters (e.g., Ø1), and angles (e.g., θ1), and exemplary values for these are shown in Table 1 below.

TABLE 1

| Measurement | Exemplary Value |
|---|---|
| D1 | 0.090 inches |
| D2 | 2.560 inches |
| D3 | 0.625 inches |
| D4 | 0.250 inches |
| D5 | 0.630 inches |
| D6 | 0.750 inches |
| D7 | 0.188 inches |
| D8 | 0.125 inches |
| D9 | 0.250 inches |
| R1 | 0.125 inches |
| φ1 | 0.250 inches |
| θ1 | 90 degrees |

Figure 6:
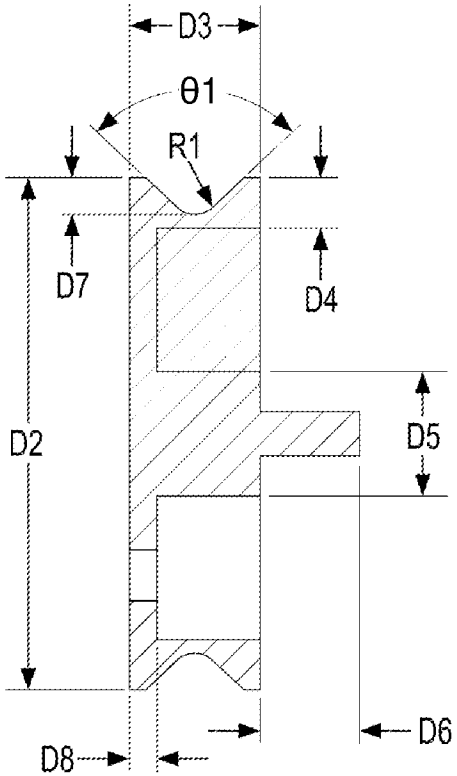
FIG. 6 is a cross-section of the disk of FIG. 5 taken along line 6-6 in FIG. 5.
Figure 5:
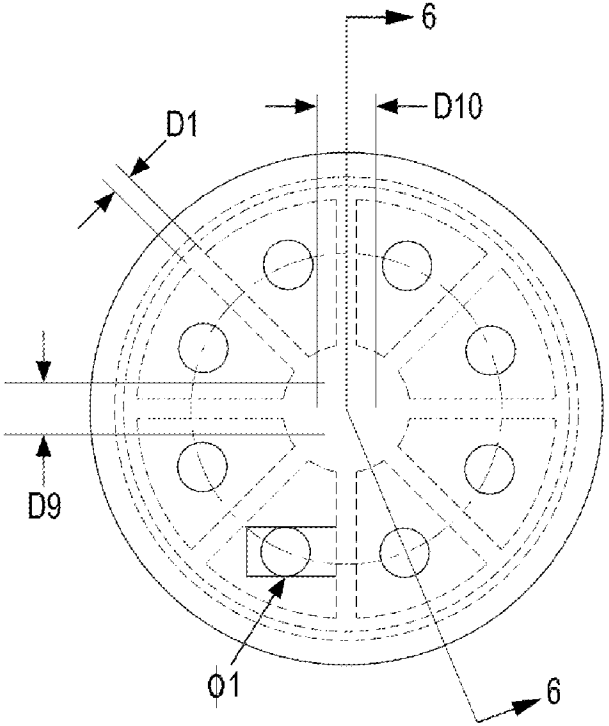
FIG. 5 is a front end view of a disk of a second embodiment of a cleaning attachment according to the present invention.

Referring to FIGS. 5 and 6, which are scale drawings, with the same scale, a second embodiment of a cleaning attachment 120 has, instead of a separate shaft as in the first embodiment, a disk 122 and shaft 124 which are molded or otherwise formed from the same material, preferably nylon, so as to form a unitary construction. Alternatively, the disk and shaft may be made of UHMWPE or other UHMW plastic, or other suitable materials. In this embodiment, given that the shaft is integrated into the disk, it will not wedge itself through shards of the disk if the disk has begun to disintegrate under pressure. Accordingly, the shaft will not pierce a sponge attached to the disk and gouge a surface that is being cleaned with the cleaning attachment.

Figure 7:
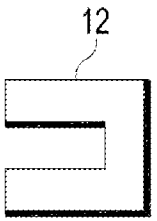
FIG. 7 is a transverse cross-section of the chuck of the rotary tool of FIG. 1.

Another difference between the first and second embodiments of the cleaning attachment is the length of the portion of the shaft that extends from the rear surface of the disk, denoted as dimension D6 in FIGS. 4 and 6. D6 is 0.75" in the first embodiment and 0.5" in the second. The axial length of the bore in chuck 12, shown in transverse cross-section in FIG. 7, is greater than ½ inch, e.g., approximately ⅝ inch. The result is that, when attached, the forwardmost end of the chuck bears against the rear surface of the disk in the second embodiment. By comparison, the longer shaft in the first embodiment bottoms out in the chuck when inserted therein. The dimensions of disk 122 are otherwise the same as those identified for disk 22 in Table 1 above. Each hex shaft (24 and 124) has a minor diameter D9 of 0.125" and a corresponding major diameter of 0.288", denoted as D10 in FIG. 6.

With the chuck bearing against the rear surface of the disk in the second embodiment, the axial compressive force exerted by the screwdriver is transmitted only via this bearing area, not through the shaft within the chuck as is the case when the screwdriver is used for its conventional purpose of screwing & unscrewing fasteners, where an interchangeable bit is inserted into the chuck and the chuck is axially spaced from the fastener such that the axial force applied to the screwdriver is transmitted through the bit to the fastener. With the second embodiment of the present invention, the more force exerted against the disk by the front end of the chuck, the more torque is transmitted to the disk via the friction between the chuck and the abutting rear surface of the disk. This helps protect the shaft from failing when excessive force is applied to the disk while it is rotating.

The cleaning attachment is prepared for use by first placing one side of a sponge against the front surface of the disk and an O-ring on the opposite side of the sponge, the sponge being large enough to cover the front surface area of the disk and extend beyond the disk periphery. The user aligns the centers of the disk, sponge and O-ring, and then rolls the O-ring over the sides of the sponge such that the O-ring circumscribes the peripheral edge groove in the disk, with at least two opposing sides of the sponge squeezed between the O-ring and the groove. These steps may be accomplished entirely by hand and/or with the use of one or more mechanical devices. For example, the shaft may be secured between two opposing thumbs while the fingers on the corresponding hands maintain compression between the disk and sponge and roll the O-ring into place. In other embodiments of the method, the shaft may be secured in place by a vise, the chuck of a rotary tool, or other mechanical device. If the shaft is not already securely engaged in the chuck of the rotary tool, it is then inserted into the chuck.

Preferably wearing rubber gloves and safety glasses, the user wets the sponge without wetting the rotary tool and applies a cleanser, e.g., Bar Keeper's Friend®, to the surface to be cleaned. In embodiments having a disk with one or more wells as described above, the cleaning liquid may be additionally or alternatively applied by pouring it into the wells. The user then activates the rotary tool to rotate the shaft, disk, O-ring and sponge. It is preferable to set the rotary tool to rotate the shaft at or below about 200 rpm, so as to prevent liquid from spraying laterally out of the sponge. The user applies force on the rotary tool such that the sponge is pressed against the surface to be cleaned, and, with embodiments having a disk with wells, rhythmically pumps the sponge against the surface to be cleaned. The compression and decompression of the sponge in this pumping action will draw cleaning liquid into the sponge from the wells, and cause the cleaning liquid to be dispersed throughout the capillaries in the sponge, aided by the centrifugal force caused by the rotation of the sponge. To guard against damage to the shaft or disk, and to maximize the amount of force applied to the sponge, it is preferable that the direction of the applied force is completely along the length of the shaft, without any component that is transverse to axis of the shaft.

The present invention takes advantage of the reversible rotation of the electric screwdriver which was intended for screwing & unscrewing, in that a sponges that is rendered too smooth to be effective when rotated in one direction can quickly regain scrubbing effectiveness by reversing direction. This can be done without removing the sponge.

The invention also allows a plain sponge, with no abrasive side, to be flipped, and the traction side of the sponge can then be used as the cleaning side. Plain sponges are cheaper than sponges with abrasives coatings. Plain sponges can be used with abrasive cleaning products in a way that is more economical that using more expensive coated sponges.

The invention also allows for universally available rectangular sponges to be driven by a round disk. This advantageously enables the two ends of a rectangular sponge which protrude from the periphery of the disk to clean curved surfaces with radii commonly found in food service equipment (e.g., the inner wall of a frying pan that gently slopes upward). In other words, the four "wings" or corners of the sponge can reach into the inside corners of a pot or a sink. In certain applications, it may suffice to use a sponge having a circular or other shape, preferably oversized relative to the disk.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. For example, the present invention also contemplates six or fewer wells in the disk, or more wells than eight, or, alternatively, a solid disk although a disk with wells is preferred.

I claim:

1. A cleaning attachment for a rotary tool having a chuck with a longitudinal bore therein, said cleaning attachment comprising:

a disk having front and rear surfaces and a peripheral edge groove therebetween, at least one well accessible from said rear surface, and a hole through a wall of said well, said hole extending through said front surface, whereby liquid held within said well is allowed to flow through said hole;

a rigid shaft extending perpendicularly from the center of said rear surface of said disk, said shaft configured to fit snugly within the bore of the rotary tool;

an O-ring circumscribing said peripheral edge groove, said O-ring having an inner diameter substantially equal to the outer diameter of said disk; and a sorbent membrane having first and second substantially parallel surfaces, one of said surfaces disposed against said front surface of said disk, and a plurality of diametrically opposed portions that are squeezed into said groove by said O-ring.

2. The cleaning attachment of claim 1, wherein said sorbent membrane is a rectangular synthetic sponge.

3. The cleaning attachment of claim 1, wherein said shaft is hexagonal in cross-section.

4. The cleaning attachment of claim 1, wherein a portion of the length of said shaft is secured within a recess in said disk.

5. The cleaning attachment of claim 1, wherein said shaft is integral to and formed from the material of said disk.

6. The cleaning attachment of claim 1, wherein the portion of said shaft extending from said rear surface of said disk is sized to fit entirely within said chuck such that the forward-most end of said chuck abuts said rear surface of said disk.

7. The cleaning attachment of claim 1, wherein said shaft comprises ferromagnetic material.

8. The cleaning attachment of claim 1, wherein said shaft is sized to fit within said bore in said chuck with a frictional engagement sufficient to support at least the weight of said cleaning attachment.

9. The cleaning attachment of claim 1, wherein said rotary tool is a cordless electric screwdriver.

10. The cleaning attachment of claim 1, wherein said rotary tool is capable of maintaining a speed of approximately 200 rpm or less.

11. A method of cleaning a surface using a handheld electric screwdriver having a chuck for holding a screwdriver bit, comprising:

mounting a sponge on the front end of said screwdriver using a disk supported by a shaft inserted into said chuck, said disk having front and rear surfaces, a peripheral edge therebetween, an annular groove formed in said peripheral edge, at least one well accessible from said rear surface, and a hole through a wall of said well, said hole extending through said front surface, whereby liquid held within said well is allowed to flow through said hole, said sponge retained on said disk by an annular band around said peripheral edge and around diametrically opposed portions of said sponge, said band applying a compressive force against said opposed sponge portions so as to press them into said peripheral edge groove;

pouring cleaning liquid into said well;

applying a cleanser to the surface to be cleaned and/or to said sponge; and activating said screwdriver to rotate said disk and said attached sponge with said sponge bearing against the surface to be cleaned.

12. The method of claim 11, wherein the rotational speed of said disk is at most about 200 rpm.

13. The method of claim 11, further comprising rhythmically pumping said sponge against the surface to be cleaned, whereby cleaning liquid is drawn into the sponge from said well.

14. The method of claim 11, wherein said mounting step includes placing one side of said sponge against said front surface of said disk;

placing an O-ring on the opposite side of said sponge;

aligning said disk, sponge and O-ring; and rolling said O-ring over the sides of the sponge such that said O-ring circumscribes said peripheral edge groove, with at least two diametrically opposed portions of said sponge squeezed between said O-ring and said groove.

15. The method of claim 14, wherein said rolling step is performed by hand with said shaft secured between a user's two opposing thumbs and with the user's fingers maintaining compression between said disk and said sponge.

* * * * *